United States Patent [19]

Gottardo et al.

[11] Patent Number: 4,976,635

[45] Date of Patent: Dec. 11, 1990

[54] LOCKING ELECTRICAL CONNECTOR

[75] Inventors: Fulvio Gottardo; Bruno Checchinato, both of Padua, Italy

[73] Assignee: Molex Incorporated, Lisle, Ill.

[21] Appl. No.: 506,124

[22] Filed: Apr. 9, 1990

[51] Int. Cl.[5] ..... H01R 11/22

[52] U.S. Cl. ..... 439/849

[58] Field of Search ..... 439/823, 832, 825, 845, 439/846, 848, 849, 850

[56] References Cited

U.S. PATENT DOCUMENTS

| | | | |
|---|---|---|---|
| 2,768,361 | 10/1956 | Aquillon et al. | 439/849 |
| 4,472,017 | 9/1984 | Sian | 439/850 |
| 4,558,913 | 12/1985 | Goto et al. | 439/849 |

*Primary Examiner*—Joseph H. McGlynn

*Attorney, Agent, or Firm*—Louis A. Hecht; Stephen Z. Weiss; Charles S. Cohen

[57] ABSTRACT

A lockable electrical connector assembly which includes a plug terminal having a locking opening therein. A sheet metal receptacle is provided for receiving the plug terminal. The receptacle has a bottom wall, a pair of upstanding side walls terminating in end portions turned inwardly over the bottom wall for engaging the plug terminal, and a resilient tongue cut-out of an opening in the bottom wall. The tongue has a tang for locking in the opening in the plug terminal for securing the terminal against removal from the receptacle. The tongue projects below the bottom wall of the receptacle for exposure to bend the tongue and release the plug terminal. Stop tabs also are cut-out of the opening in the bottom wall of the receptacle in the path of bending movement of the tongue to prevent overstressing the tongue by limiting the amount of bending movement of the tongue.

20 Claims, 3 Drawing Sheets

LOCKING ELECTRICAL CONNECTOR

FIELD OF THE INVENTION

This invention generally relates to electrical connectors and, more particularly, to a lockable electrical connector assembly which includes a sheet metal receptacle for locking with a plug terminal.

BACKGROUND OF THE INVENTION

Various electrical connectors are formed from sheet metal and include a receptacle portion having a bottom wall and a pair of upstanding side walls terminating in end portions turned inwardly over the bottom wall. The receptacle is adapted to receive a plug terminal such as a flat male tab. A resilient tongue is formed from the base and has a tang which cooperates with a cut-out formed in the flat male tab in order to secure the tab or plug terminal against removal from the receptacle.

The receptacle often is inserted into a duct-shaped housing and locked therein for receiving the plug terminal. The housing may include a cam actuator for engaging the receptacle tongue to bend the tongue in response to pulling on the housing, to release the plug terminal.

Such electrical connectors often are used in electrical circuits associated with machinery which are subjected to vibrations and other forces. In such environments, the electrical connector affords good electrical contact and, at the same time, it provides a releasable connection between the plug terminal and the receptacle. Examples of such connectors are shown in U.S. Pat. Nos. 4,550,963 to Moors, dated Nov. 5, 1985; 4,579,409 to Enneper et al., dated Apr. 1, 1986; 4,632,483 to Verin, dated Dec. 30, 1986; 4,542,948 to Alonso et al., dated Sept. 24, 1985; 4,690,478 to Rahrig et al., dated Sept. 1, 1987; and 4,458,971 to D'Urso et al., dated July 10, 1984.

One of the problems with electrical connectors of the above type is over-stressing of the tongue which locks the plug terminal in the receptacle. The tongue often is unitarily formed or stamped out of the base or bottom wall of the receptacle so as to be resilient to provide for locking and ready release of the plug terminal. In order to be releasable by the housing, the tongue projects below the bottom wall of the receptacle for engagement by cam means on the housing to move the tongue out of locking engagement with the terminal. During manufacturing, shipping, handling or the like, i.e., prior to insertion into the housing, the resilient tongue cannot be bent past a given point or else it will become overstressed and loose its resiliency and even may be deformed. If the tongue is bent too far, its locking function is less effective and it may be bent so far as to be completely ineffective. In addition, even a small degree of deformation will increase the insertion force on the plug terminal. This invention is directed to solving this problem in a very simple and efficient manner.

SUMMARY OF THE INVENTION

An object, therefore, of the invention is to provide a new and improved locking electrical connector of the character described.

In the exemplary embodiment of the invention, a locking electrical connector is fabricated of sheet metal and includes a receptacle for receiving a plug terminal such as a flat male tab. The receptacle has a bottom wall, a pair of upstanding side walls terminating in end portions turned inwardly over the bottom wall for engaging the plug terminal, and a resilient tongue unitary with the bottom wall. The tongue has means cooperating with the plug terminal for securing the terminal against removal from the receptacle, such as a tang formed out of the sheet metal tongue for locking in an opening in the flat plug terminal.

Generally, the tongue projects below the bottom wall of the receptacle for exposure to bend the tongue and release the plug terminal, such as by cam means on a duct-shaped housing in which the receptacle is inserted. The invention contemplates providing stop means formed directly on the bottom wall of the receptacle in the path of bending movement of the tongue to prevent overstressing the tongue by limiting the amount of bending movement of the tongue.

More particularly, the tongue is formed from a cut-out in the bottom wall of the receptacle in such a manner that the tongue has a free end resilient about a root end integral with the receptacle bottom wall. The tongue is T-shaped and includes a cross-portion of the T-shape forming the free end of the tongue. The bottom wall has a pair of tabs integral therewith and projecting inwardly toward each other in the path of movement of the cross-portion of the tongue whereby the tongue cannot be bent beyond a given point, as the tabs provide stops for engagement by the cross-portion of the T-shape tongue.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
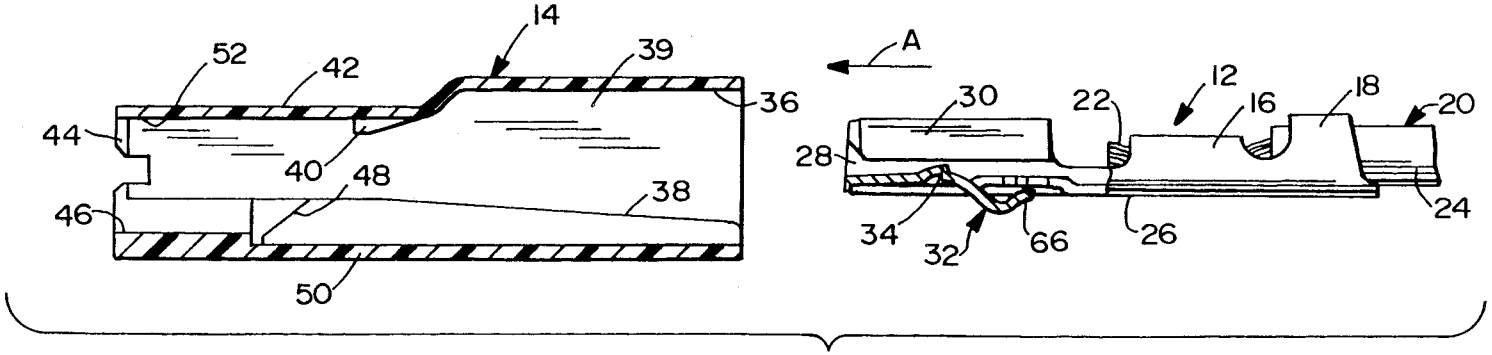
FIG. 1 is a side elevational view of a connector receptacle and a connector housing according to the invention, with the housing and a portion of the receptacle in section.
Figure 2:
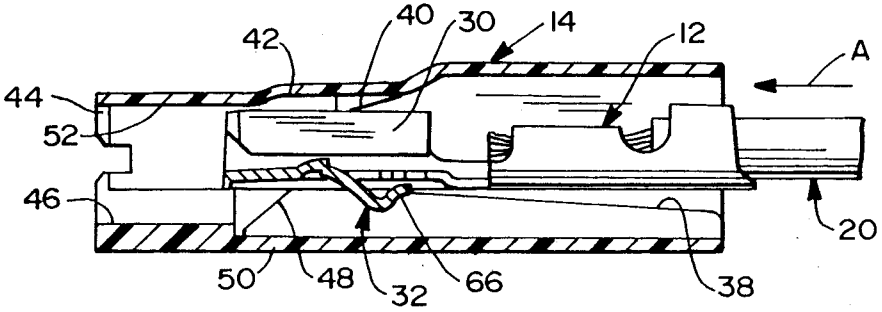
FIG. 2 is a view similar to that of FIG. 1, with the receptacle partially inserted into the housing.

Referring to the drawings in greater detail, and first to FIG. 1, the invention is directed to a lockable electrical connector which includes a connector receptacle, generally designated 12, for insertion into a duct-shaped connector housing, generally designated 14, in the direction of arrow "A".

Receptacle 12 is fabricated of sheet metal and has two pairs of bendable arms 16 and 18 for clamping onto an electrical cable, generally designated 20, in a conventional manner. In other words, arms 16 are clamped onto exposed conductive strands 22 (or a single wire) of the cable for conduction purposes, while arms 18 are clamped onto the outer covering or cladding 24 of the cable for strain relief purposes. The receptacle includes a generally flat bottom wall 26 and a pair of upstanding side walls 28, the side walls terminating in end portions 30 turned inwardly over the bottom wall for engaging a plug terminal, as described hereinafter. Again, this structure is generally conventional. As will be described in greater detail hereinafter, a resilient tongue, generally designated 32, is unitarily formed or stamped out of bottom wall 26 and projects below the bottom wall, as shown. The tongue has a tang 34 projecting upwardly into the receptacle for locking with the plug terminal to secure the terminal against removal from the receptacle.

As stated, housing 14 is generally duct-shaped. It has a rear opening 36 for receiving receptacle 12 in the direction of arrow "A". The housing conventionally is formed of dielectric material and includes ramps 38 molded integrally with opposite side walls 39 for guiding the receptacle into proper position within the housing. Dielectric housing 14 also includes a rear latch boss 40 projecting downwardly from a top wall 42, a front latch flange 44 at a front opening 46, and a bottom cam boss 48 projecting upwardly from a bottom wall 50 adjacent each opposite side wall. As will be seen hereinafter, latch boss 40 and latch flange 44 lock receptacle 14 in the housing, and cam boss 48 is effective to release tongue 32 from locking engagement with the plug terminal.

Figure 3:
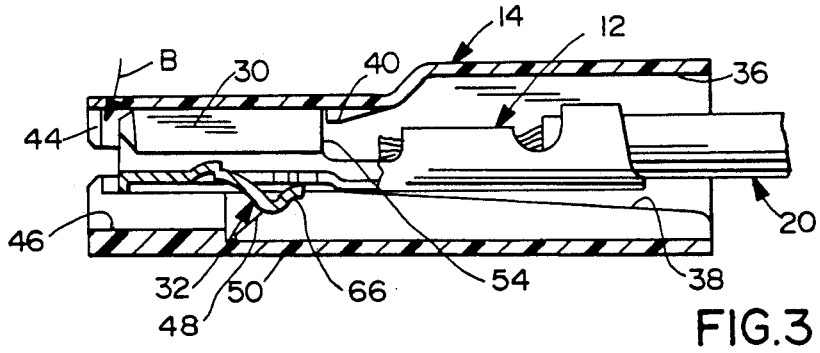
FIG. 3 is a sequential view similar to that of FIG. 2, with the receptacle fully inserted into the housing.

FIG. 3 shows receptacle 12 partially inserted into housing 14 in the direction of arrow "A". It can be seen that ramp 38 of the housing directs the receptacle into a forward reduced-dimensioned interior area 52 of the duct-shaped housing, the area being just slightly larger than the front end of the receptacle to provide a fairly tight fit to prevent vibrations. In addition, end portions 30 of the receptacle and top wall 42 of the molded dielectric housing are sufficiently flexible whereby the receptacle can be pushed past rear locking latch 40.

FIG. 3 shows receptacle 12 fully inserted into housing 14, with rear edges 54 of the turned over end portions 30 of the receptacle snapped behind and into locking engagement with latch boss 40. At this point, it should be understood that FIGS. 1–8 are sectional views through housing 14. Therefore, there is a rear latch boss 40, a front latch flange 44, and a cam boss 48 on the other, interior side of the housing adjacent the side wall thereof (not shown) opposite side wall 39. Obviously, only one of each such component is viewable in the sectional views of FIGS. 1–8.

For purposes described hereinafter, it should be noted in FIG. 3 that there is a given amount of axial movement between receptacle 12 and housing 14 when the receptacle is fully latched within the housing, as represented in the area indicated by arrow "B" (FIG. 3).

Figure 4:
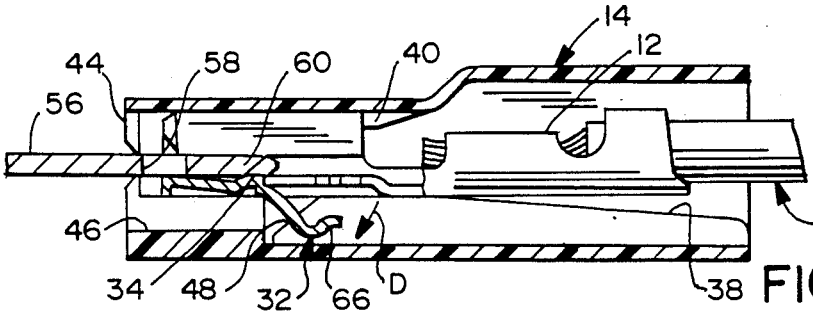
FIG. 4 is a view similar to that of FIG. 3, with the plug terminal partially inserted into the receptacle.

FIG. 4 shows a plug terminal 56 insertable into receptacle 12 (within housing 14) in the direction of arrow "C", through front opening 46 of the housing. The plug terminal is a flat male tab-type terminal and includes a locking opening 58 formed therethrough spaced from a distal end 60 thereof. It can be seen that the distal end of the plug terminal has engaged tang 34 which projects upwardly from resilient tongue 32 and has biased the tongue downwardly in the direction of arrow "D".

Figure 5:
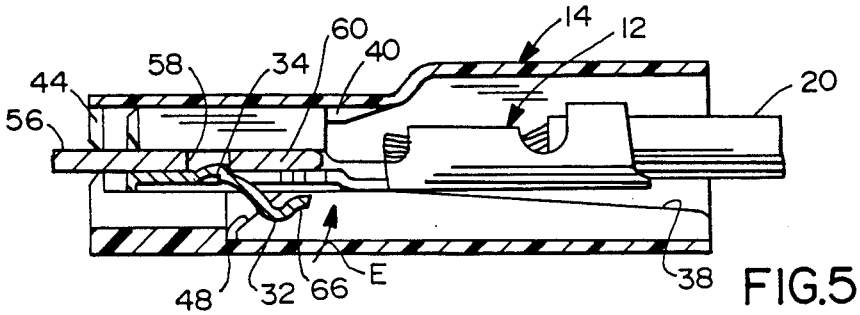
FIG. 5 is a sequential view similar to that of FIG. 4, with the plug terminal fully inserted into the receptacle and locked thereby.
Figure 6:
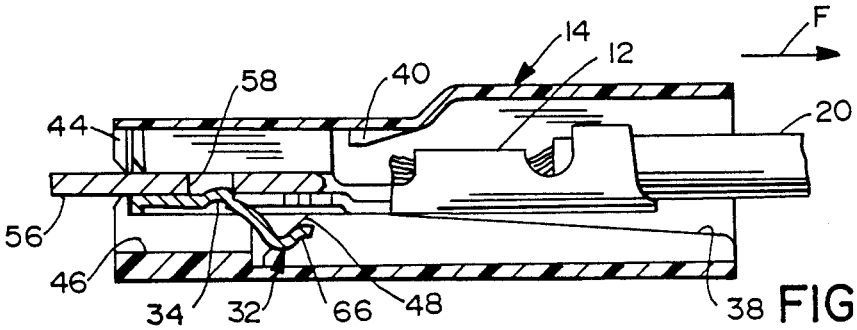
FIG. 6 is a view similar to that of FIG. 5, with the housing moved toward the right for engaging the tongue of the receptacle.

FIG. 5 shows plug terminal 56 fully inserted into receptacle 12 within housing 14. It can be seen that tongue 32 has moved upwardly in the direction of arrow "E" under the influence of its resiliency and has biased tang 34 upwardly into locking engagement within opening 58 in the plug terminal. The plug terminal now cannot be removed from the receptacle. In other words, if an individual grasps cable 20 and plug terminal 56 and pulls in opposite directions, the receptacle and the plug terminal cannot be pulled apart because of the locking engagement of tang 34 within opening 58. These are the normal forces exerted on the connector system during use and against which the lockable connector is effective. It should be noted that there is a space 59 between cam boss 48 and tongue 32.

In order to remove the plug terminal from the receptacle, opposite forces must be applied to the plug terminal and housing 14. More particularly, referring to FIG. 6, opposite forces must be applied to housing 14 in the direction of arrow "F" and plug terminal 56 in the direction of arrow "G". When this happens, receptacle 12 is moved off of latching boss 40 and into abutment with latching flange 44. This can be seen by space 60 which correspond to the size of space "B" in FIG. 3. In addition, it can be seen that cam boss 48 now has come into engagement with tongue 32.

Figure 7:
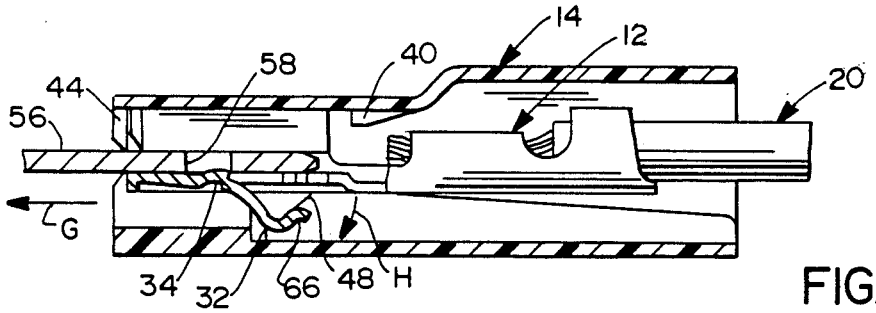
FIG. 7 is a sequential view similar to that of FIG. 6, with the housing moved further to move the tongue out of locking engagement with the plug terminal.
Figure 8:
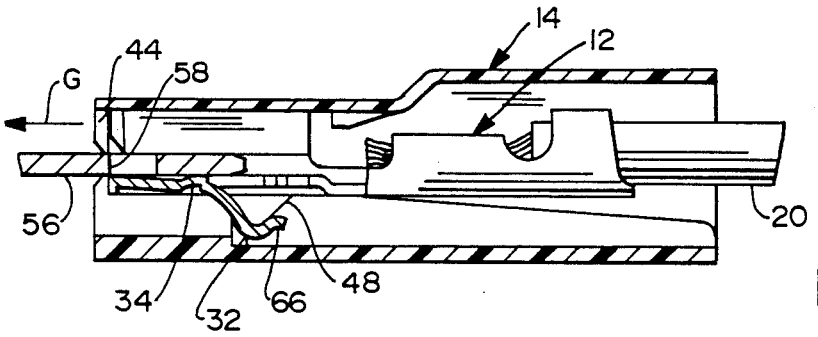
FIG. 8 is a sequential view similar to that of FIG. 7, with the plug terminal partially pulled away from the receptacle outwardly of the housing.

Referring to FIG. 7, continued pulling on housing 14 and terminal 56 in the opposite directions of arrows "F" and "G" causes cam boss 48 to bias tongue 32 downwardly in the direction of arrow "H" to pull tang 34 out of opening 58 in the terminal. This unlocks the terminal whereby it can be completely withdrawn from the receptacle in the direction of arrow "G" as shown in FIG. 8.

Figure 9:
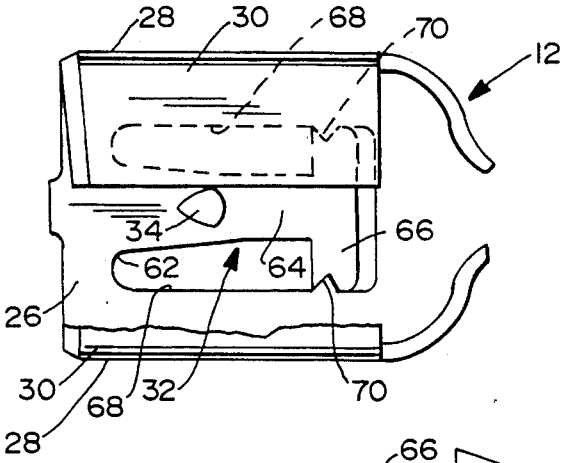
FIG. 9 is a fragmented top plan view on an enlarged scale, showing the construction of the receptacle tongue and stop means for preventing overstressing of the tongue.
Figure 10:
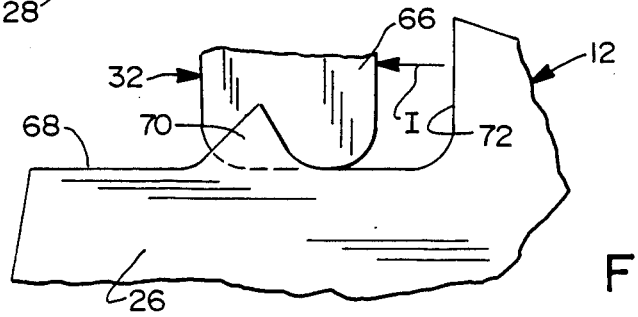
FIG. 10 is a fragmented plan view, on a further enlarged scale, showing the location of one of the stop tabs on the bottom wall of the receptacle in the path of movement of the cross-portion of the T-shape tongue.

Referring to FIGS. 9 and 10, tongue 32 is shown to be generally T-shaped, integrally joined to bottom wall 46 at a root area 62, and including a leg 64 and an arm 67, the arm forming the "cross" of the T-shape. It can be seen that tang 34 is formed integrally from leg 64 of the T-shaped tongue. The tongue is formed or stamped out of an opening 68 in bottom wall 26 of the receptacle. During forming of the receptacle, the tongue is bent into the configuration as shown in FIGS. 1–8 so as to be inclined downwardly and bowed upwardly whereby the tongue projects below the bottom wall of the receptacle for exposure and bending in response to engagement by cam boss 48 of housing 14. Actually, as described above, there are two cam bosses 48 along each opposite side wall 39 of the housing. These two cam bosses are positioned for engaging the outwardly projecting opposite ends of arm 66 of the resilient tongue. The tongue thereby can be moved about its root area 62, as a fulcrum, in a resilient manner.

Generally, the invention contemplates providing means for preventing overstressing of tongue 32 by limiting the amount of bending movement of the tongue. As stated above, the tongue, being stamped and formed from sheet metal material, cannot be overly bent or deformed or else the tongue will loose its resiliency. This would have a lesser effective interaction in locking plug terminal 56 within the receptacle. The tongue might be deformed to an extent that cam boss 48 on the housing would not be able to disconnect tang 34 from within opening 58 in the plug terminal. Still further, deformation or overstressing of the tongue would increase the insertion force on the plug terminal when mating the terminal with the receptacle.

To that end, a pair of stop tabs 70 are formed integrally with bottom wall 26 along opposite edges of opening 68 in the path of bending movement of cross arm 66 of tongue 32, as seen in FIGS. 9 and 10. These tabs block the tongue should any external forces be exerted to move the tongue upwardly into the interior of the receptacle.

Both tongue 32 and tabs 70 can be stamped out of bottom wall 26, within opening 68, even though the tabs end up in the same path as arm 66 of the tongue, because the tongue is formed into the shape shown in FIGS. 1–8, resulting in the arm 66 being "moved" in the direction of arrow "I" (FIG. 10) away from an edge 62 of opening 68 during the forming process. Therefore, the ends of arm 66 will underly tabs 70, i.e., the tabs ending up in the path of bending movement of the cross-arm portion of the T-shaped tongue. By forming the stop means out of the sheet metal bottom wall, the stop means can be provided in a single step at the same time as stamping the T-shaped tongue out of opening 68. No extra coining or like steps are required.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a lockable electrical connector including a receptacle for receiving a plug terminal, the receptacle having a bottom wall, a pair of upstanding side walls terminating in end portions turned inwardly over the bottom wall for engaging the plug terminal, a resilient tongue unitary with the bottom wall, the tongue having means cooperating with the plug terminal for securing the terminal against removal from the receptacle, and the tongue projecting below the bottom wall for exposure to bend the tongue and release the plug terminal, the improvement comprising stop means on the bottom wall of the receptacle in a path of bending movement of the tongue to prevent overstressing the tongue by limiting the amount of bending movement of the tongue.

2. In a lockable electrical connector as set forth in claim 1 wherein said receptacle is fabricated of sheet metal with the tongue being cut-out of an opening in the bottom wall of the receptacle.

3. In a lockable electrical connector as set forth in claim 2 wherein said stop means also is cut-out of the opening in the bottom wall.

4. In a lockable electrical connector as set forth in claim 3 wherein said stop means projects inwardly of an edge of the opening.

5. In a lockable electrical connector as set forth in claim 2 wherein said tongue is generally T-shaped, with a root of a leg of the T-shape being joined integrally with the bottom wall and about which the tongue resiliently flexes.

6. In a lockable electrical connector as set forth in claim 5 wherein said stop means comprise a pair of stop tabs cut-out of the opening in the bottom wall and located in a path of bending movement of opposite ends of a cross-portion of the T-shaped tongue.

7. In a lockable electrical connector as set forth in claim 6 wherein said stop tabs project inwardly from opposite edges of the opening.

8. A lockable electrical connector assembly, comprising:

a plug terminal having an opening therein spaced from a distal end thereof;

a receptacle for receiving the plug terminal and including a bottom wall, a pair of upstanding side walls terminating in end portions turned inwardly over the bottom wall for engaging the plug terminal, a resilient tongue unitary with the bottom wall, the tongue having a tang for locking in the opening in the plug terminal to secure the terminal against removal from the receptacle, the tongue projecting below the bottom wall for exposure to bend the tongue and pull the tang out of the opening in the plug terminal for releasing the terminal, and stop means on the bottom wall of the receptacle in a path of bending movement of the tongue to prevent overstressing the tongue by limiting the amount of bending movement of the tongue; and a duct-shaped housing for receiving the receptacle and including means for latching the receptacle therein, the housing having cam means for engaging the tongue on the receptacle to release the plug terminal in response to opposed forces exerted on the housing and the plug terminal.

9. The lockable electrical connector assembly of claim 8 wherein said receptacle is fabricated of sheet metal with the tongue being cut-out of an opening in the bottom wall of the receptacle.

10. The lockable electrical connector assembly of claim 9 wherein said stop means also is cut-out of the opening in the bottom wall.

11. The lockable electrical connector assembly of claim 10 wherein said stop means projects inwardly of an edge of the opening.

12. The lockable electrical connector assembly of claim 9 wherein said tongue is generally T-shaped, with a root of a leg of the T-shape being joined integrally with the bottom wall and about which the tongue resiliently flexes.

13. The lockable electrical connector assembly of claim 12 wherein said stop means comprise a pair of stop tabs cut-out of the opening in the bottom wall and located in a path of bending movement of opposite ends of a cross-portion of the T-shaped tongue.

14. The lockable electrical connector assembly of claim 13 wherein said stop tabs project inwardly from opposite edges of the opening.

15. In a lockable electrical connector including a sheet metal receptacle for receiving a plug terminal, the receptacle having a bottom wall and a resilient tongue cut-out of the bottom wall, the tongue having means cooperating with the plug terminal for securing the terminal against removal from the receptacle, the tongue being resiliently flexible to release the plug terminal, the improvement comprising stop means on the bottom wall of the receptacle in the path of bending movement of the tongue to prevent overstressing the tongue by limiting the amount of bending movement of the tongue.

16. In a lockable electrical connector as set forth in claim 15 wherein said tongue is cut-out of an opening in the bottom wall of the receptacle.

17. In a lockable electrical connector as set forth in claim 16 wherein said stop means is cut-out of the opening in the bottom wall and projects inwardly of an edge of the opening.

18. In a lockable electrical connector as set forth in claim 16 wherein said tongue is generally T-shaped, with a root of a leg of the T-shape being joined integrally with the bottom wall and about which the tongue resiliently flexes.

19. In a lockable electrical connector as set forth in claim 18 wherein said stop means comprise a pair of stop tabs cut-out of the opening in the bottom wall and located in a path of bending movement of opposite ends of a cross-portion of the T-shaped tongue.

20. In a lockable electrical connector as set forth in claim 19 wherein said stop tabs project inwardly from opposite edges of the opening.

* * * * *